US008831465B2

(12) United States Patent
Yamane et al.

(10) Patent No.: US 8,831,465 B2
(45) Date of Patent: Sep. 9, 2014

(54) IMAGE FORMING APPARATUS HAVING A SUCTION DEVICE AND A DUCT WITH PORTS HAVING VENTILATION AREAS DEPENDENT ON PROXIMITY TO THE SUCTION DEVICE

(71) Applicant: KYOCERA Document Solutions Inc., Osaka (JP)

(72) Inventors: Shinji Yamane, Osaka (JP); Masaki Hayashi, Osaka (JP)

(73) Assignee: Kyocera Document SolutionsInc. (JP)

( * ) Notice: Subject to any disclaimer, the term of this patent is extended or adjusted under 35 U.S.C. 154(b) by 43 days.

(21) Appl. No.: 13/762,738

(22) Filed: Feb. 8, 2013

(65) Prior Publication Data

US 2013/0216255 A1 Aug. 22, 2013

(30) Foreign Application Priority Data

Feb. 20, 2012 (JP) ..... 2012-034351

(51) Int. Cl.
*G03G 21/20* (2006.01)
*G03G 21/10* (2006.01)
*G03G 15/08* (2006.01)

(52) U.S. Cl.
CPC ..... *G03G 21/10* (2013.01); *G03G 21/105* (2013.01); *G03G 15/0898* (2013.01); *G03G 21/206* (2013.01)
USPC ..... 399/92; 399/98; 399/99

(58) Field of Classification Search
USPC ..... 399/92, 98, 99
See application file for complete search history.

(56) References Cited

U.S. PATENT DOCUMENTS

| | | | | |
|---|---|---|---|---|
| 6,067,428 | A * | 5/2000 | Zirilli et al. | 399/92 |
| 6,411,788 | B1 * | 6/2002 | Ogasawara | 399/92 |
| 6,621,995 | B1 * | 9/2003 | Rejewski et al. | 399/92 |
| 7,043,172 | B2 * | 5/2006 | Koshimura et al. | 399/99 |
| 7,123,854 | B1 * | 10/2006 | Cellura et al. | 399/92 |
| 7,447,462 | B2 * | 11/2008 | Nishimura et al. | 399/92 |
| 7,809,304 | B2 * | 10/2010 | Hatano et al. | 399/92 |
| 7,991,318 | B2 * | 8/2011 | Tamura et al. | 399/92 |
| 2002/0186986 | A1 * | 12/2002 | Makihira | 399/92 |

FOREIGN PATENT DOCUMENTS

| | | |
|---|---|---|
| JP | 10-26861 | 1/1998 |
| JP | 2002-278387 | 9/2002 |
| JP | 2005-84564 | 3/2005 |
| JP | 2008-145826 | 6/2008 |

* cited by examiner

*Primary Examiner* — G. M. Hyder
(74) *Attorney, Agent, or Firm* — Gerald E. Hespos; Michael J. Porco; Matthew T. Hespos

(57) ABSTRACT

The present application discloses an image forming apparatus for forming an image by means of toner. The image forming apparatus includes an image carrier including an image carrying surface to form an electrostatic latent image; a developing device which supplies the toner to the image carrying surface to form a toner image; and a suction device configured to create airflow for suctioning the toner scattered from the developing device. The developing device includes a duct configured to guide the airflow to the suction device. The duct includes a connection surface, to which the suction device is connected, and a suction surface provided with suction ports into which the toner flows. The suction ports aligned in a direction apart from the connection surface include different suction ports in ventilation area.

10 Claims, 13 Drawing Sheets

IMAGE FORMING APPARATUS HAVING A SUCTION DEVICE AND A DUCT WITH PORTS HAVING VENTILATION AREAS DEPENDENT ON PROXIMITY TO THE SUCTION DEVICE

This application is based on Japanese Patent Application No. 2012-034351 filed in Japan Patent Office on Feb. 20, 2012, the contents of which are hereby incorporated by reference.

BACKGROUND

The present disclosure relates to an image forming apparatus which has functions for suctioning toner.

An image forming apparatus such as a printer or a copier often includes a photosensitive drum, which has a circumferential surface to form an electrostatic latent image, a developing device, which supplies toner to the circumferential surface of the photosensitive drum, and a transfer roller, which transfers a toner image formed on the photosensitive drum to a sheet. When the developing device supplies toner to the circumferential surface of the photosensitive drum on which the electrostatic latent image is formed, a toner image is formed on the circumferential surface of the photosensitive drum. During passage of a sheet between the photosensitive drum and the transfer roller, the toner image on the circumferential surface of the photosensitive drum is transferred to the sheet.

The developing device typically includes a developing roller situated near the circumferential surface of the photosensitive drum. Toner on the developing roller is attracted electrostatically to the photosensitive drum. However, all of toner particles do not adhere to the circumferential surface of the photosensitive drum.

While the toner is transferred from the developing roller to the circumferential surface of the photosensitive drum, the photosensitive drum and the developing roller rotate. Toner particles, which fail to adhere to the photosensitive drum, are carried by resultant airflow from the rotations of the photosensitive drum and the developing roller and float inside the image forming apparatus. The floating toner particles may contaminate sheets conveyed in the image forming apparatus.

Various technologies for collecting such toner particles floating in the image forming apparatus have been proposed.

A layout, in which a photosensitive drum, a developing device and a transfer roller come closer together, or another layout to convey sheets vertically contribute significantly to a reduction in size of an image forming apparatus and improvement of image forming speed. Therefore, various devices are often gathered around the photosensitive drum.

If floating toner is suctioned in a direction substantially orthogonal to a sheet conveyance direction, a suction device configured to generate airflow for suctioning the floating toner may be placed more freely in comparison to a suction structure for suctioning the floating toner in a direction substantially parallel to the sheet conveying direction. Accordingly, technologies for suctioning the floating toner in a direction substantially orthogonal to the sheet conveyance direction may be easily applied to the layout in which the aforementioned devices come closer together around the photosensitive drum.

If a suction device connected to a suction port formed on a side surface of a housing of the developing device is used to suction floating toner in a direction substantially orthogonal to a sheet conveyance direction, a strong suction force occurs near a suction port whereas a low suction force occurs at a distant position from the suction port. The floating toner may not be recovered appropriately in such a suction force distribution.

An object of the present disclosure is to provide an image forming apparatus with a recovery structure configured to recover toner by means of suction forces with a small positional fluctuation.

SUMMARY

An image forming apparatus according to one aspect of the present disclosure includes an image carrier including an image carrying surface to form an electrostatic latent image; a developing device which supplies the toner to the image carrying surface to form a toner image; and a suction device configured to create airflow for suctioning the toner scattered from the developing device. The developing device includes a duct configured to guide the airflow to the suction device. The duct includes a connection surface, to which the suction device is connected, and a suction surface provided with suction ports into which the toner flows. The suction ports aligned in a direction apart from the connection surface include different suction ports in ventilation area.

DETAILED DESCRIPTION

An exemplary image forming apparatus is described below with reference to the accompanying drawings. The purpose of directional terms such as "top", "bottom", "left" and "right" hereinafter is to simply clarify description of the image forming apparatus. The drawings or the following detailed descriptions should not be construed as limiting principles of the image forming apparatus.

<Image Forming Apparatus>

Figure 1:
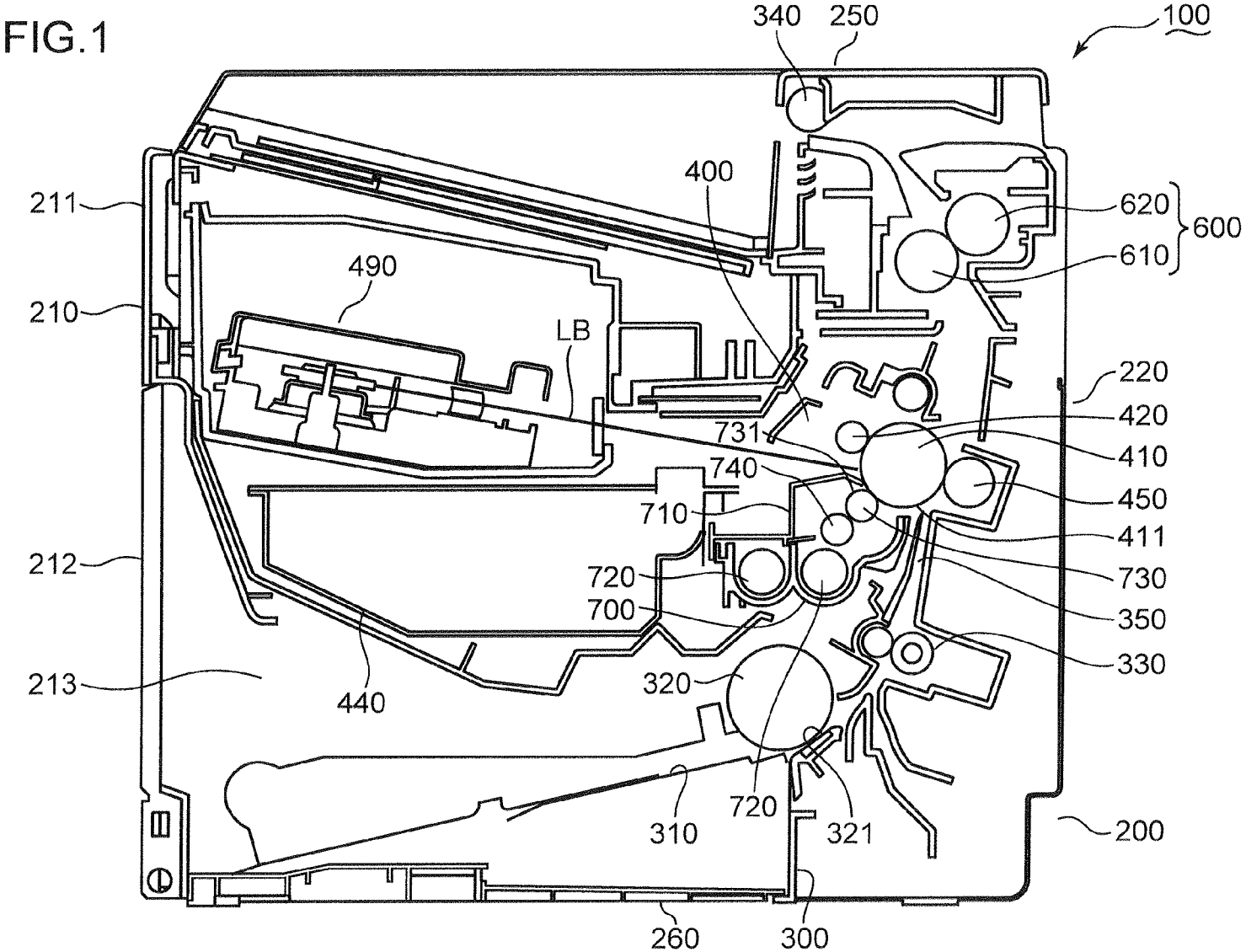
FIG. 1 is a schematic cross-sectional view of a printer exemplified as the image forming apparatus.
Figure 2:
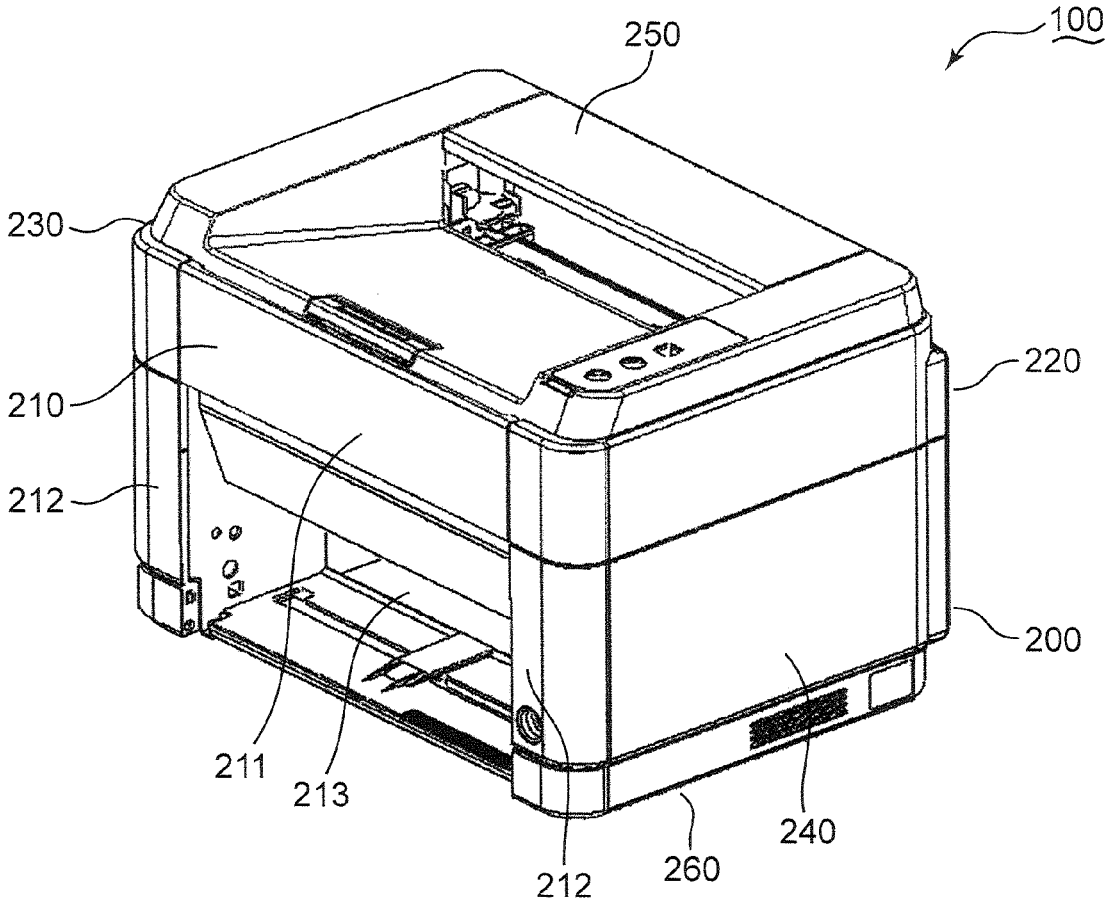
FIG. 2 is a schematic perspective view of the printer shown in FIG. 1.

FIG. 1 is a schematic cross-sectional view of the printer 100 exemplified as the image forming apparatus. FIG. 2 is a schematic perspective view of the printer 100. The printer 100 is described with reference to FIGS. 1 and 2.

The printer 100 includes a main housing 200 which is shaped in a rectangular box. Various devices for forming images (to be described hereinafter) are stored in the main housing 200.

The main housing 200 includes an upright front wall 210, a back wall 220 opposite to the front wall 210, an upright left wall 230 between the front and back walls 210, 220, and a right wall 240 opposite to the left wall 230. The main housing 200 further includes an upper wall 250, which covers a region surrounded by the upper edges of the front, back, left and right walls 210, 220, 230, 240, and a lower wall 260 opposite to the upper wall 250.

The front wall 210 includes a front cover 211 adjacent to the front edge of the upper wall 250, and upright plates 212 on the left and right of the front cover 211. The front cover 211 extends horizontally along the front edge of the upper wall 250 whereas the upright plate 212 extends downward from the front edge of the upper wall 250. Accordingly, the front wall 210 is shaped in a gate to define an opening 213 in a lower portion of the main housing 200.

The printer 100 has a cassette 300 configured to store sheets. The cassette 300 is inserted into the main housing 200 through the opening 213 defined by the front wall 210. The cassette 300 includes a lift plate 310 configured to support the sheets. The lift plate 310 pushes the leading edges of the sheets.

The printer 100 further includes a feed roller 320, which hits the leading edges of the sheets pushed up by the lift plate 310, and a division plate 321 adjacent to the feed roller 320. The feed roller 320 rotates to pull each sheet from the cassette 300. The division plate 321 applies a frictional force to a lower surface of each sheet. If the feed roller 320 pulls a few sheets from the cassette 300, the sheets are separated by the frictional force of the division plate 321. If the feed roller 320 pulls one sheet from the cassette 300, the feed roller 320 overcomes the frictional force of the division plate 321 and sends the sheet to downstream. Accordingly, the sheets are sent one by one to downstream. The sheets are then moved upward through a conveying path formed along the back wall 220 of the main housing 200.

The printer 100 further includes a resist roller pair 330, which receives the sheets sent from the feed roller 320, and an image forming portion 400 for forming an image on each sheet. The resist roller pair 330 feeds the sheets to the image forming portion 400 in synchronization with image forming steps (to be described hereinafter) of the image forming portion 400.

The image forming portion 400 includes a photosensitive drum 410, which has a circumferential surface 411 to form an electrostatic latent image and toner image, a charger 420, which charges the circumferential surface 411 of the photosensitive drum 410 uniformly, and an exposure device 490, which radiates a laser beam LB onto the charged circumferential surface 411 of the photosensitive drum 410. The printer 100 receives image data from an external device (e.g. a personal computer (not shown)). The exposure device 490 emits the laser beam LB in response to the image data while the photosensitive drum 410 is rotated. Therefore, an electrostatic latent image is formed on the circumferential surface 411 of the photosensitive drum 410 which is charged by the charger 420. In the present embodiment, the circumferential surface 411 of the photosensitive drum 410 is covered with amorphous silicon (a-Si). Alternatively, the circumferential surface of the photosensitive drum may be formed from a material capable of forming an electrostatic latent image.

In the present embodiment, the photosensitive drum 410 is exemplified as the image carrier. The circumferential surface 411 of the photosensitive drum 410 is exemplified as the image carrying surface.

The image forming portion 400 further includes a developing device 700 configured to supply toner to the circumferential surface 411 of the photosensitive drum 410, on which the electrostatic latent image is formed, and a toner container 440 which supplies the toner to the developing device 700. A toner image coincident with the electrostatic latent image is formed on the circumferential surface 411 of the photosensitive drum 410 by the toner supplied from the developing device 700. The toner container 440 supplies the toner to the developing device 700 as appropriate not to short toner in the developing device 700. A structure of the developing device 700 is described hereinafter.

The image forming portion 400 further includes a transfer roller 450 configured to receive the sheets, which the resist roller pair 330 sends, in cooperation with the photosensitive drum 410. During passage of a sheet between the photosensitive drum 410 and the transfer roller 450, the transfer roller 450 attracts the toner image formed on the circumferential surface 411 of the photosensitive drum 410. Consequently, the toner image is transferred to the sheet. The photosensitive drum 410 and the transfer roller 450 then send the sheet upward.

The printer 100 further includes a fixing device 600 configured to fix the toner image onto each sheet. The fixing device 600 includes a heat roller 610, which generates heat for melting the toner on the sheet, and a pressure roller 620 configured to press a surface of the sheet, on which the toner image is formed, against the heat roller 610. The sheet sent by the photosensitive drum 410 and the transfer roller 450 passes through between the heat roller 610 and the pressure roller 620. Meanwhile, the toner melted by the heat roller 610 penetrates the sheet to fix the toner image to the sheet. The fixing device 600 then sends the sheet further upward.

The printer 100 further includes a discharge roller 340. The fixing device 600 sends the sheet to the discharge roller 340. The discharge roller 340 discharges the sheet from the main housing 200.

<Developing Device>

Figure 3:
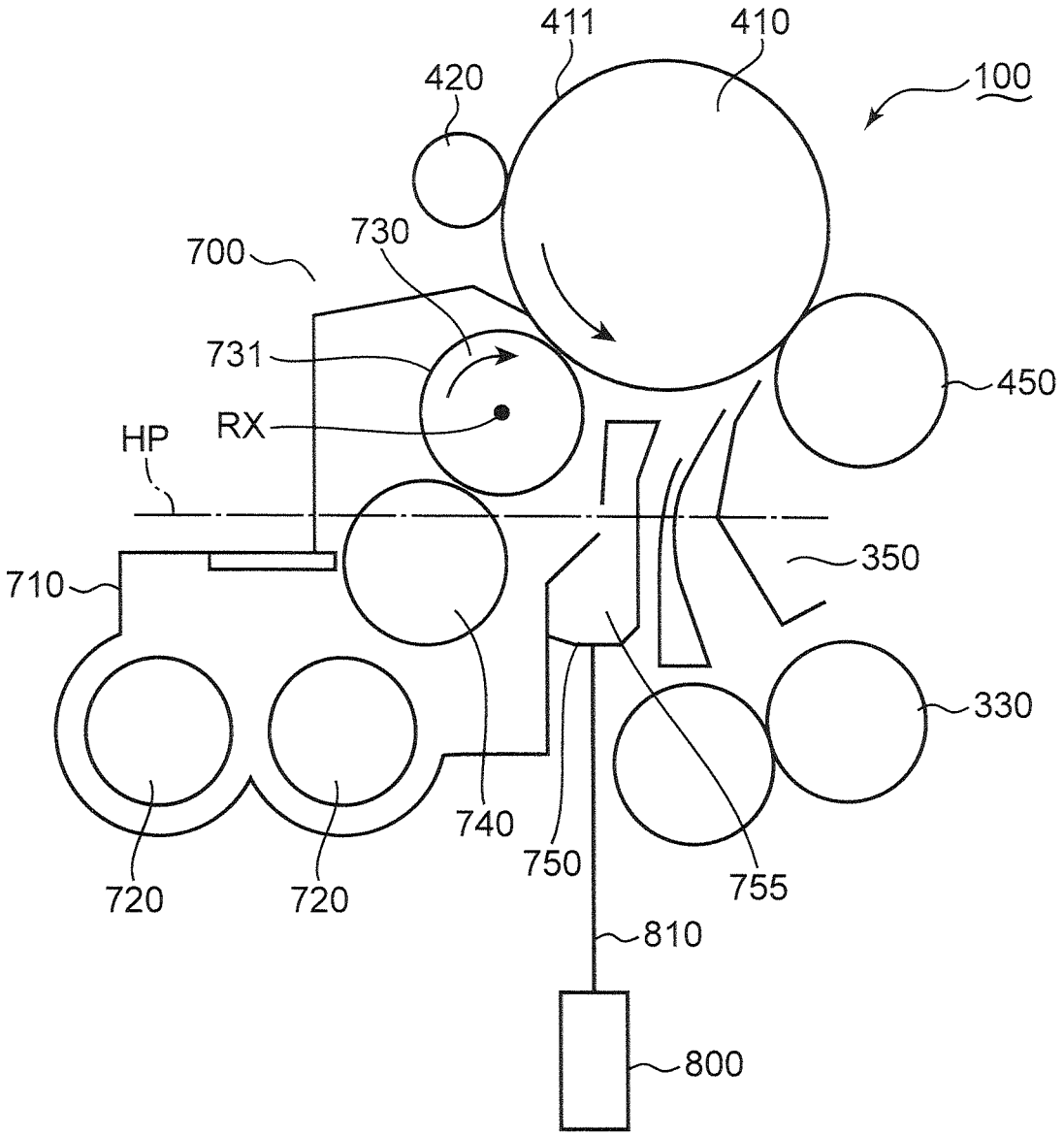
FIG. 3 is a schematic enlarged view of the printer shown in FIG. 1.

FIG. 3 is a schematic enlarged view of the printer 100 around the developing device 700. The developing device 700 is described with reference to FIGS. 1 and 3.

The developing device 700 includes a housing 710, which stores the toner supplied from the toner container 440, a stirring roller pair 720, which stirs toner in the housing 710, a developing roller 730 situated near the photosensitive drum 410, and a feed roller 740 between the developing roller 730 and the stirring roller pair 720. In the present embodiment, two-component toner is supplied from the toner container 440 to the housing 710. The stirring roller pair 720 stirs the toner supplied from the toner container 440 and delivers the stirred toner to the feed roller 740. The feed roller 740 sends the toner to the developing roller 730. Consequently, a toner layer is formed on the circumferential surface 731 of the developing roller 730.

The exposure device 490 radiates the laser beam LB onto the circumferential surface 411 of the photosensitive drum 410, which is charged uniformly by the charger 420. Consequently, a potential difference in response to image data is created on the circumferential surface 411 of the photosensitive drum 410. The toner layer formed on the developing roller 730 rotating near the photosensitive drum 410 is attracted to the photosensitive drum 410 in response to the potential difference on the circumferential surface 411 of the photosensitive drum 410. Consequently, the toner image is formed on the circumferential surface 411 of the photosensitive drum 410.

Some of toner particles forming the toner layer on the developing roller 730 are scattered from the circumferential surfaces 411, 731 of the photosensitive drum 410 and the developing roller 730. The printer 100 includes a vacuum device 800 configured to creates airflow for suctioning the scattered toner particles. In the present embodiment, the vacuum device 800 is exemplified as the suction device.

The developing device 700 further includes a guide tube 750 configured to guide the airflow directed toward the vacuum device 800. The vacuum device 800 includes a connecting tube 810 which is connected to the guide tube 750. In the present embodiment, the guide tube 750 is exemplified as the duct. A structure of the duct is described hereinafter.

The printer 100 includes a guide path 350 configured to guide a sheet sent from the resist roller pair 330. The sheet is guided between the transfer roller 450 and the photosensitive drum 410 by the guide path 350.

The guide tube 750 is situated between the developing roller 730 and the guide path 350. Therefore, toner floating toward the guide path 350 is recovered appropriately by a suction force generated on the guide tube 750 by the vacuum device 800, so that the sheet passing through the guide path 350 is less likely to be contaminated by the floating toner.

Figure 4:
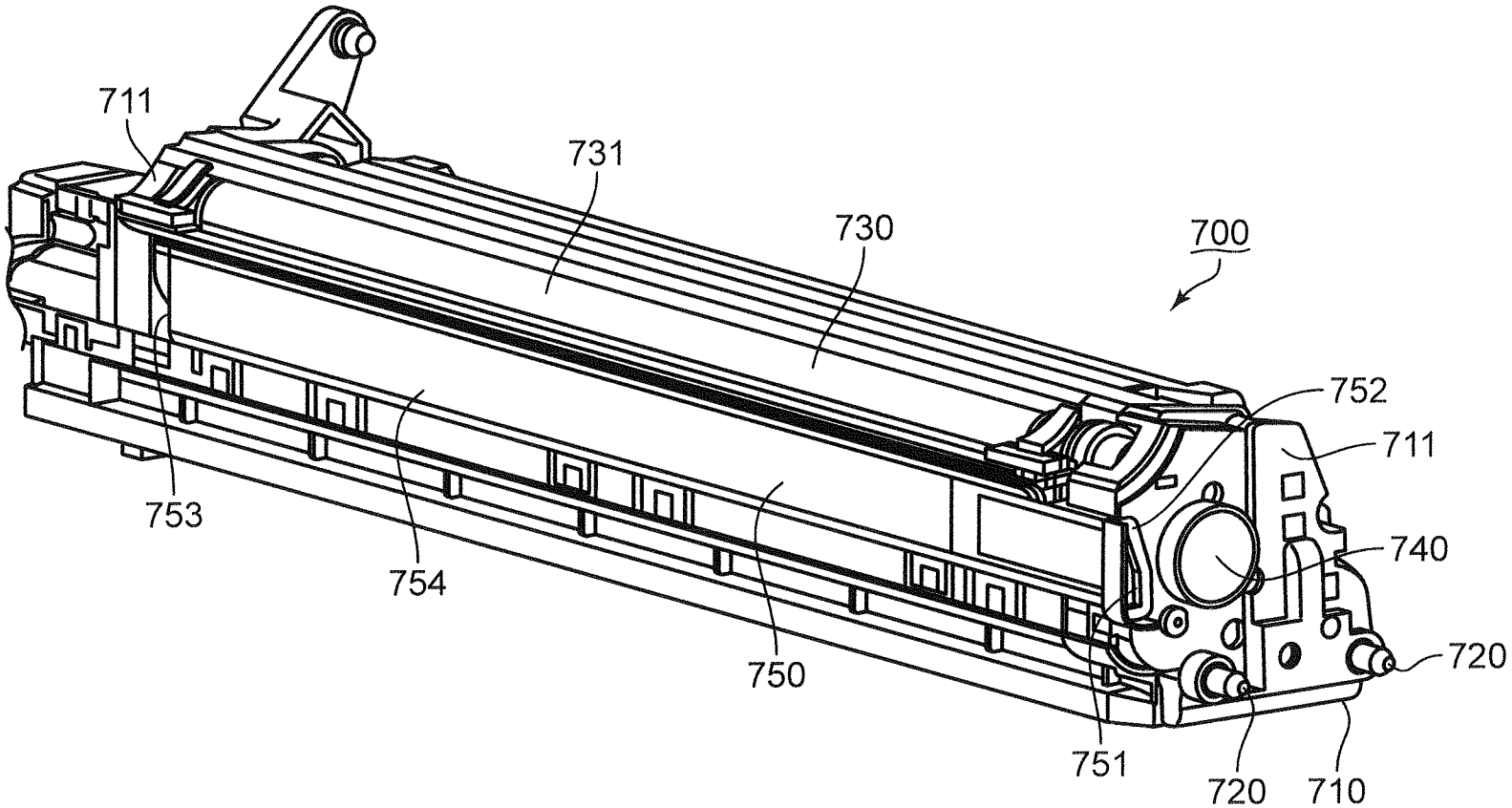
FIG. 4 is a schematic perspective view of a developing device of the printer shown in FIG. 1.
Figure 5:
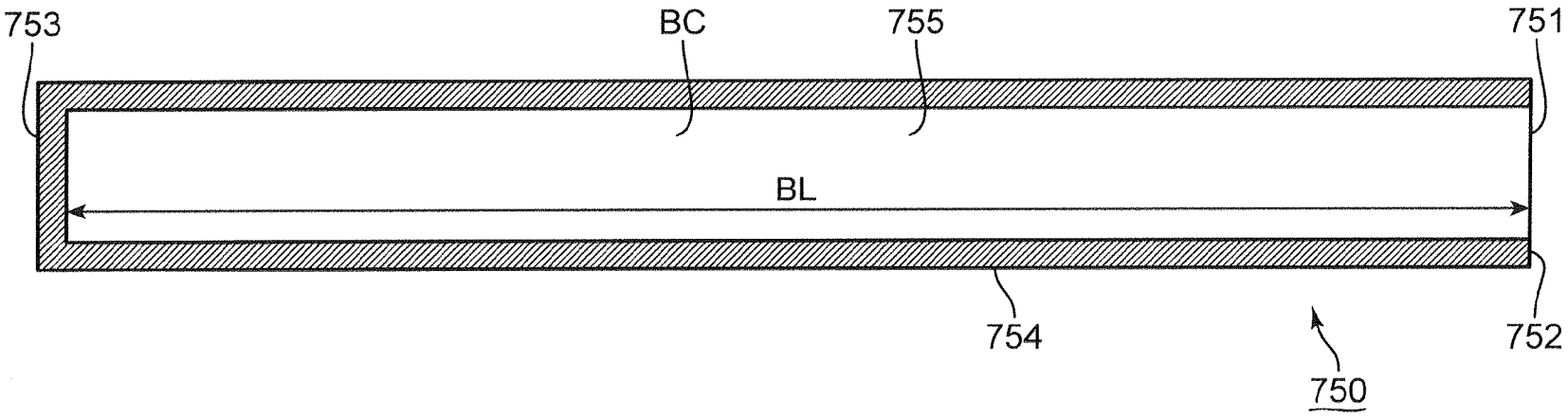
FIG. 5 is a schematic cross-sectional view of a guide tube attached to the developing device shown in FIG. 4.

FIG. 4 is a schematic perspective view of the developing device 700. FIG. 5 is a schematic cross-sectional view of the guide tube 750. The developing device 700 is further described with reference to FIGS. 3 to 5.

As shown in FIG. 4, the housing 710 includes a pair of support walls 711 configured to support the stirring roller pair 720, the feed roller 740 and the developing roller 730. The stirring roller pair 720, the feed roller 740 and the developing roller 730 extend between the support walls 711.

The guide tube 750 is attached to the housing 710 of the developing device 700. The guide tube 750 extends in a direction substantially parallel to the extension direction of the stirring roller pair 720, the feed roller 740 and the developing roller 730.

As shown in FIG. 5, the guide tube 750 includes an opening end surface 752, on which an opening 751 is formed, and a closing wall 753 opposite to the opening end surface 752. The guide tube 750 further includes a circumferential wall 754 extending between the opening end surface 752 and the closing wall 753.

The connecting tube 810 is connected to the opening end surface 752. The closing wall 753 and the circumferential wall 754 define a cavity 755 through which airflow caused by the vacuum device 800 passes. The closing wall 753 closes the cavity 755. In the present embodiment, the opening end surface 752 is exemplified as the connecting surface. The closing wall 753 is exemplified as the closing surface.

In FIG. 5, a length of the cavity 755 is indicated by the reference numeral "BL". A capacity of the guide tube 750 is indicated by the reference numeral "BC". In this case, the average internal cross-sectional area SD of the guide tube 750 is expressed by the following equation.

$$SD = \frac{BC}{BL} \quad \text{[Equation 1]}$$

Figure 6:
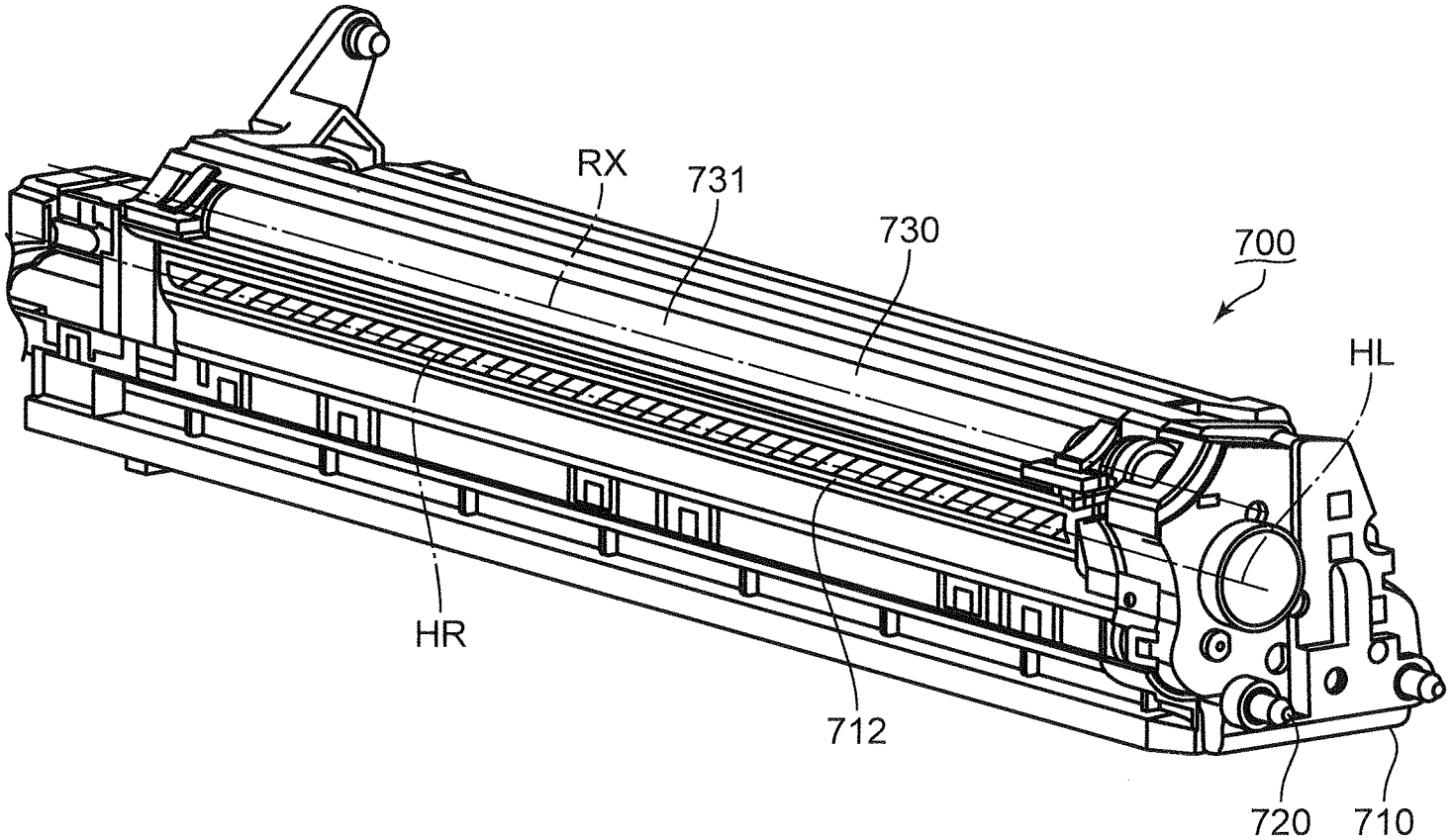
FIG. 6 is a schematic perspective view of the developing device shown in FIG. 4.

FIG. 6 is a schematic perspective view of the developing device 700. It should be noted that the guide tube 750 described with reference to FIG. 4 is removed from the developing device 700 shown in FIG. 6. The developing device 700 is further described with reference to FIGS. 3 to 6.

The housing 710 further includes an attachment wall 712 to which the guide tube 750 is attached. FIG. 6 shows a hatched region HR on the attachment wall 712. Several suction ports, which are arranged in various patterns as described hereinafter, are formed in the region HR. Several suction ports described hereinafter are formed on the circumferential wall 754 of the guide tube 750 as well. Thus, the suction ports on the attachment wall 712 are communicated to the suction ports formed on the circumferential wall 754 of the guide tube 750. As described above, the vacuum device 800 suctions air inside the cavity 755. Therefore, toner scattered from the developing roller 730 flows into the guide tube 750 via the suction ports. In the present embodiment, in addition to the guide tube 750, the attachment wall 712 is also exemplified as the duct. The attachment wall 712 and a part of the circumferential surface 754 of the guide tube 750, which is connected to the attachment wall 712, is exemplified as the suction surface.

Ventilation areas (opening areas) of the suction ports formed in the region HR in accordance with the following various suction port arrangement patterns are set to be no more than the average internal cross-sectional area SD of the guide tube 750.

<Suction Port Arrangement Patterns>

(First Arrangement Pattern)

Figure 7:
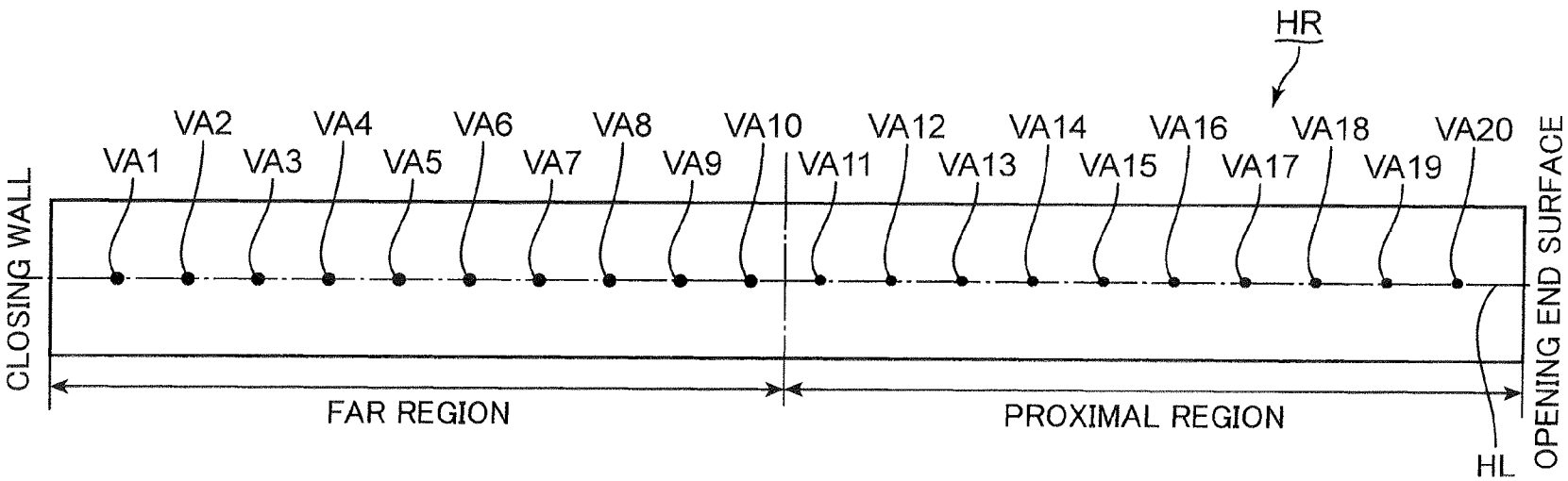
FIG. 7 schematically shows a first arrangement pattern of suction ports formed in the developing device depicted in FIG. 6.

FIG. 7 schematically shows a first arrangement pattern of the suction ports VA1 to VA20 arranged in the region HR. The first arrangement pattern of the suction ports VA1 to VA2 is described with reference to FIGS. 3, 5 to 7.

The suction ports VA1 to VA20 are arranged in a direction apart from the opening end surface 752. The numbers in the reference numerals "VA1 to VA20" assigned to the suction ports are incremented by one from the closest suction port VA1 to the closing wall 753. In the present embodiment, a number of suction ports formed in the region HR is "20." Therefore, reference numeral "VA20" is assigned to the closest suction port to the opening end surface 752.

In the present embodiment, the region HR is divided into two sections: a proximal region near the opening end surface 752 and a far region which is farther from the opening end surface 752 than the proximal region is. The suction ports VA1 to VA10 are formed in the far region. The suction ports VA11 to VA20 are formed in the proximal region. In the present embodiment, the proximal region is exemplified as the first region. The far region is exemplified as the second region. The suction ports VA1 to VA10 are exemplified as the first suction port group. The suction ports VA11 to VA20 are exemplified as the second suction port group.

The ventilation areas of the suction ports VA1 to VA10 formed in the far region are equal to one another. The ventilation areas of the suction ports VA11 to VA20 formed in the proximal region are also equal to one another. However, the ventilation areas of the suction ports are different between the far and proximal regions. The suction ports VA1 to VA10 are wider than the suction ports VA11 to VA20. In the present embodiment, the sum of the ventilation areas of the suction ports VA1 to VA10 is set at, for example, "51 mm2". The sum of the ventilation areas of the suction ports VA11 to VA20 is set at, for example, "34 mm2". The average internal cross-sectional area SD of the guide tube 750 is set at "100 mm2". Therefore, the total ventilation area (85 mm2) of the suction ports formed in the region HR is smaller than the average internal cross-sectional area SD (100 mm2) of the guide tube 750.

A number of suction ports formed in each of the proximal and far regions is "10". Therefore, the average ventilation area (3.4 mm2) of the suction ports VA11 to VA20 formed in the proximal region is smaller than the average ventilation area (5.1 mm2) of the suction ports VA1 to VA10 formed in the far region.

In FIGS. 6 and 7, the horizontal line HL is marked with a dashed line. As shown in FIG. 7, the suction ports VA1 to VA10 are aligned along the horizontal line HL.

In FIG. 3, the horizontal plane HP, which passes through the horizontal line HL shown in FIG. 7 is marked with a dashed line. Each of FIGS. 3 and 6 shows the rotational axis RX of the developing roller 730. The developing roller 730 is rotated around the rotational axis RX. As shown in FIG. 3, the horizontal plane HP is situated below the rotational axis RX of the developing roller 730. Therefore, the toner scattered from the developing roller 730 may be easily recovered through the suction ports VA1 to VA20, not only by the suction force of the vacuum device 800 but also by the action of gravity.

As shown in FIG. 6, the rotational axis RX of the developing roller 730 is substantially parallel to the horizontal line HL. In other words, the suction ports VA1 to VA20 are formed along the horizontal line HL substantially parallel to the rotational axis RX of the developing roller 730. Therefore, the suction ports VA1 to VA20 may cause a suction effect substantially evenly over the entire length of the developing roller 730.

Figure 8:
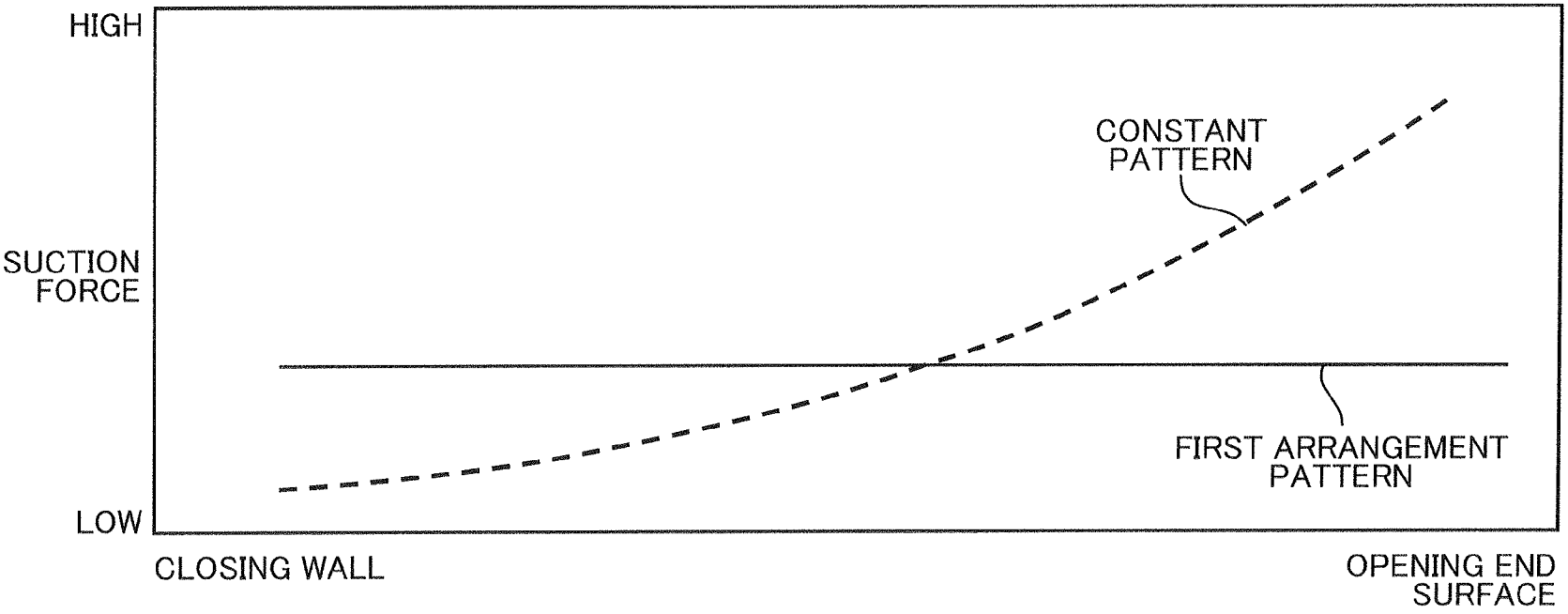
FIG. 8 is a schematic graph qualitatively showing a positional fluctuation of suction forces caused on the suction ports arranged according to the first arrangement pattern depicted in FIG. 7.

FIG. 8 is a schematic graph qualitatively showing a positional fluctuation of suction forces generated on the suction ports VA1 to VA20 arranged according to the first arrangement pattern. The positional fluctuation of the suction forces is described with reference to FIGS. 6 to 8.

The curved line expressed in a solid line in FIG. 8 shows the positional fluctuation of the suction forces generated by the suction ports VA1 to VA20 arranged according to the first arrangement pattern. The curved line expressed in a dotted line in FIG. 8 shows a positional fluctuation of suction forces generated over the region HR by suction ports each of which has a constant ventilation area (referred to as "constant pattern" hereinafter). It should be noted that the positions of the suction ports formed according to the constant pattern are the same as those of the suction ports VA1 to VA20 shown in FIG. 7.

If the suction ports are formed in accordance with the constant pattern, the suction force becomes large near the opening end surface. The suction force gradually weakens toward the closing wall. Toner floating near the closing wall may be recovered insufficiently under the suction force distribution.

In the present embodiment, the suction ports VA11 to VA20 formed in the proximal region are smaller than the suction ports VA1 to VA10 formed in the far region. Therefore, the suction force does not become excessively strong near the opening end surface 752. Consequently, the suction force increases near the closing wall 753. Therefore, the positional fluctuation of the suction forces is reduced over the entire length of the developing roller 730.

(Second Arrangement Pattern)

Figure 9:
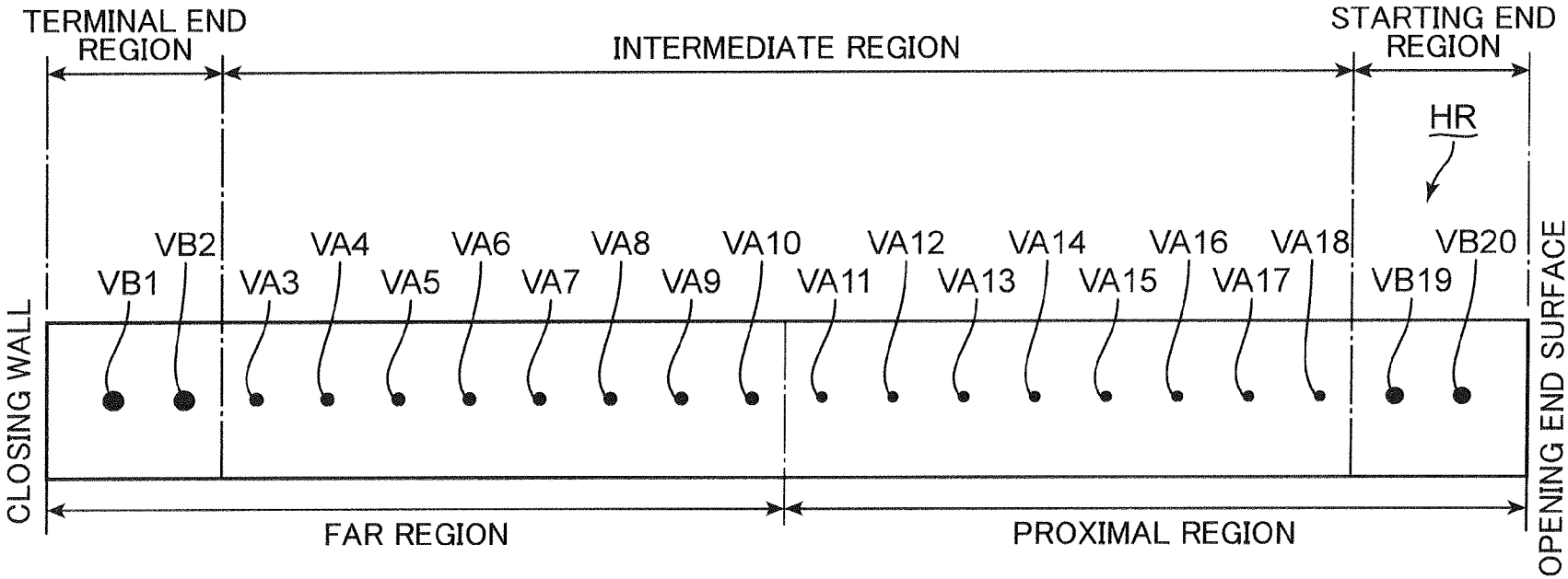
FIG. 9 schematically shows a second arrangement pattern of the suction ports formed in the developing device depicted in FIG. 6.

FIG. 9 schematically shows a second arrangement pattern of the suction ports arranged in the region HR. The second arrangement pattern of the suction ports is described with reference to FIGS. 7 and 9. It should be noted that the same features of the second arrangement pattern as the first arrangement pattern are not described hereinafter.

In accordance with the second arrangement pattern, the suction ports VA3 to VA18 described in the context of the first arrangement pattern are formed in the region HR. The suction port VB1 is formed instead of the suction port VA1 described with reference to FIG. 7. The suction port VB2 is formed instead of the suction port VA2 described with reference to FIG. 7. The suction port VB19 is formed instead of the suction port VA19 described with reference to FIG. 7. The suction port VB20 is formed instead of the suction port VA20 described with reference to FIG. 7. The suction ports VB1, VB2, VB19, VB20 are larger than the suction ports VA11 to VA18.

The suction port VB1 has the same ventilation area as the suction port VB2. The suction port VB 19 has the same ventilation area as the suction port VB20. Each of the suction ports VB19, VB 20 has the same ventilation area as each of the suction ports VB1, VB2. Therefore, like the first arrangement pattern, the average ventilation area of the suction ports VA11 to VA18, VB19, VB20 formed in the proximal region is smaller than that of the suction ports VB1, VB2, VA3 to VA10 formed in the far region in the second arrangement pattern.

In the following description, a region near the closing wall 753 in which the suction ports VB1, VB2 are formed is referred to as "terminal end region". A region near the opening end surface 752 in which the suction ports VB19, VB20 are formed is referred to as "starting end region". A region between the starting and terminal end regions is referred to as "intermediate region". The suction ports VA3 to VA18 are formed in the intermediate region. The region HR is divided into the terminal end region, the starting end region and the intermediate region.

In the present embodiment, the suction ports VB1, VB2 are exemplified as the terminal end suction port group. The suction ports VA3 to VA18 are exemplified as the intermediate suction port group. The suction ports VB19, VB20 are exemplified as the starting end suction port group.

As described above, the average ventilation area of the suction ports VA3 to VA18 is smaller than that of the suction ports VB1, VB2. The average ventilation area of the suction ports VA3 to VA18 is smaller than that of the suction ports VB19, VB20.

Figure 10:
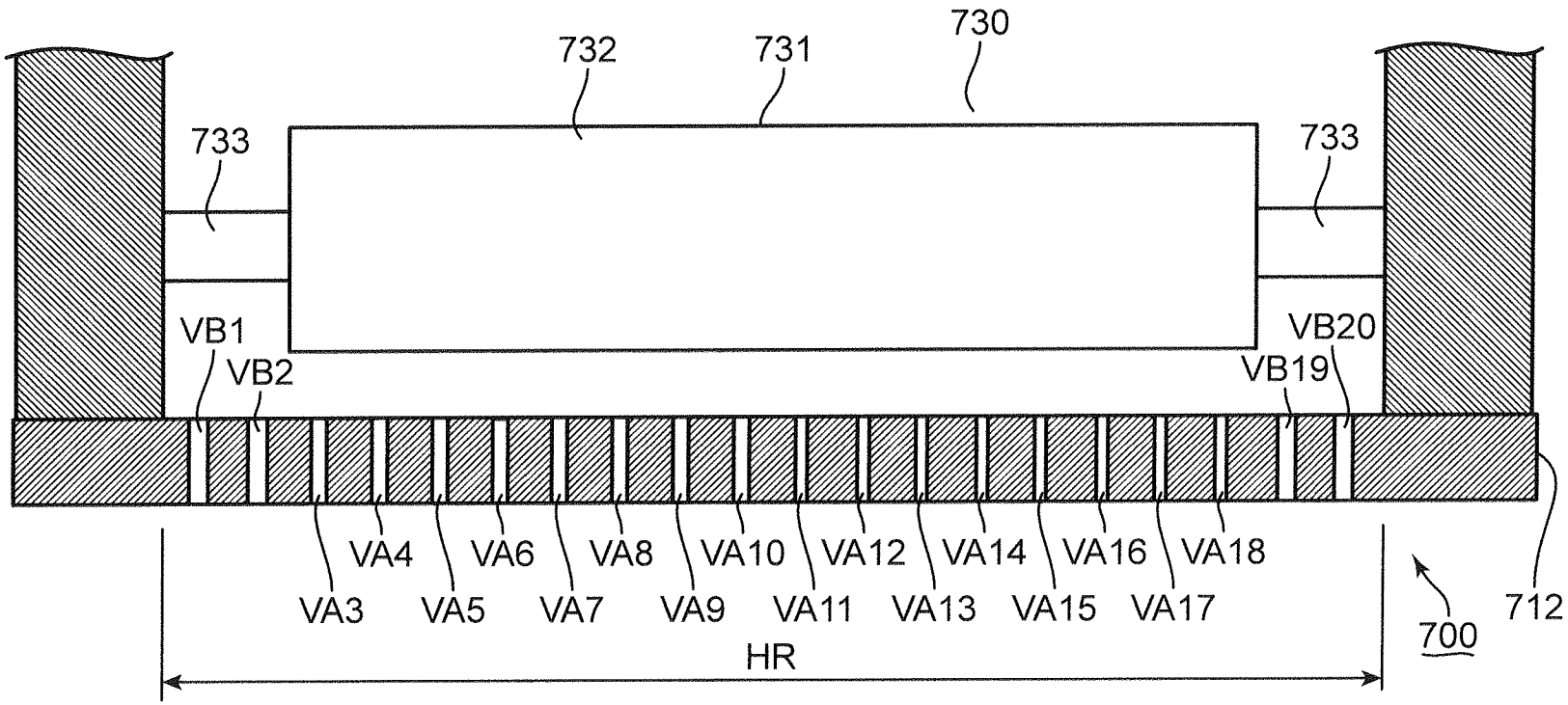
FIG. 10 is a schematic cross-sectional view of the developing device shown in FIG. 6.

FIG. 10 is a schematic cross-sectional view of the developing device 700 around the developing roller 730. The second arrangement pattern is described with reference to FIGS. 3 and 10.

The developing roller 730 includes a cylindrical trunk 732, which has a circumferential surface 731 to supply toner to the circumferential surface 411 of the photosensitive drum 410, and paired journals 733, each of which extends from the trunk 732 along the rotational axis RX of the developing roller 730. The journals 733 are thinner than the trunk 732. Therefore, there is a wider space between the attachment wall 712 and each of the journals 733 than the space between the attachment wall 712 and the trunk 732.

Figure 11:
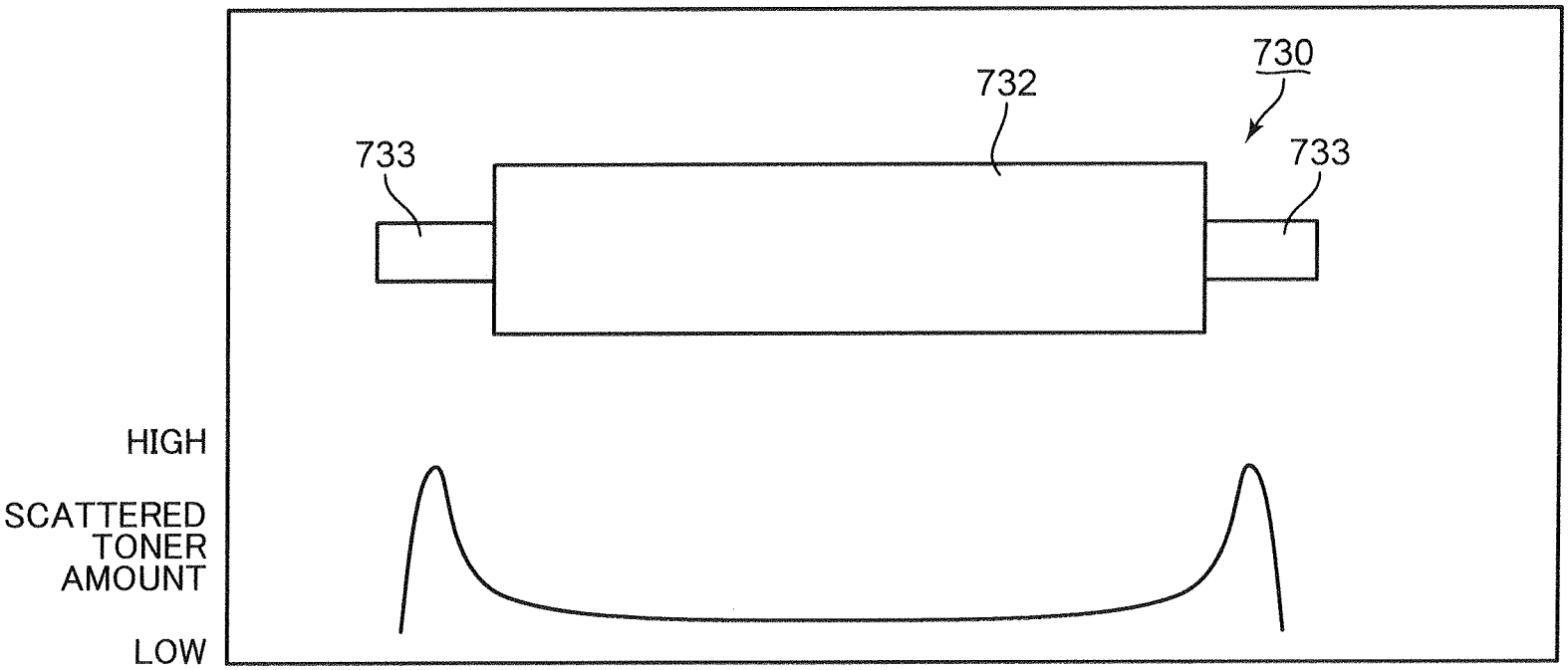
FIG. 11 is a schematic graph qualitatively showing a positional fluctuation of a toner amount scattered below a developing roller of the developing device depicted in FIG. 10.

FIG. 11 is a schematic graph qualitatively showing a positional fluctuation of a toner amount scattered below the developing roller 730 depicted in FIG. 10. The positional fluctuation of the scattered toner amount is described with reference to FIGS. 10 and 11.

As described above, there is the wider space between the attachment wall 712 and each of the journals 733 than the space between the attachment wall 712 and the trunk 732. Therefore, toner is more likely to scatter in the space between the attachment wall 712 and the journals 733 than in the space between the attachment wall 712 and the trunk 732.

Figure 12:
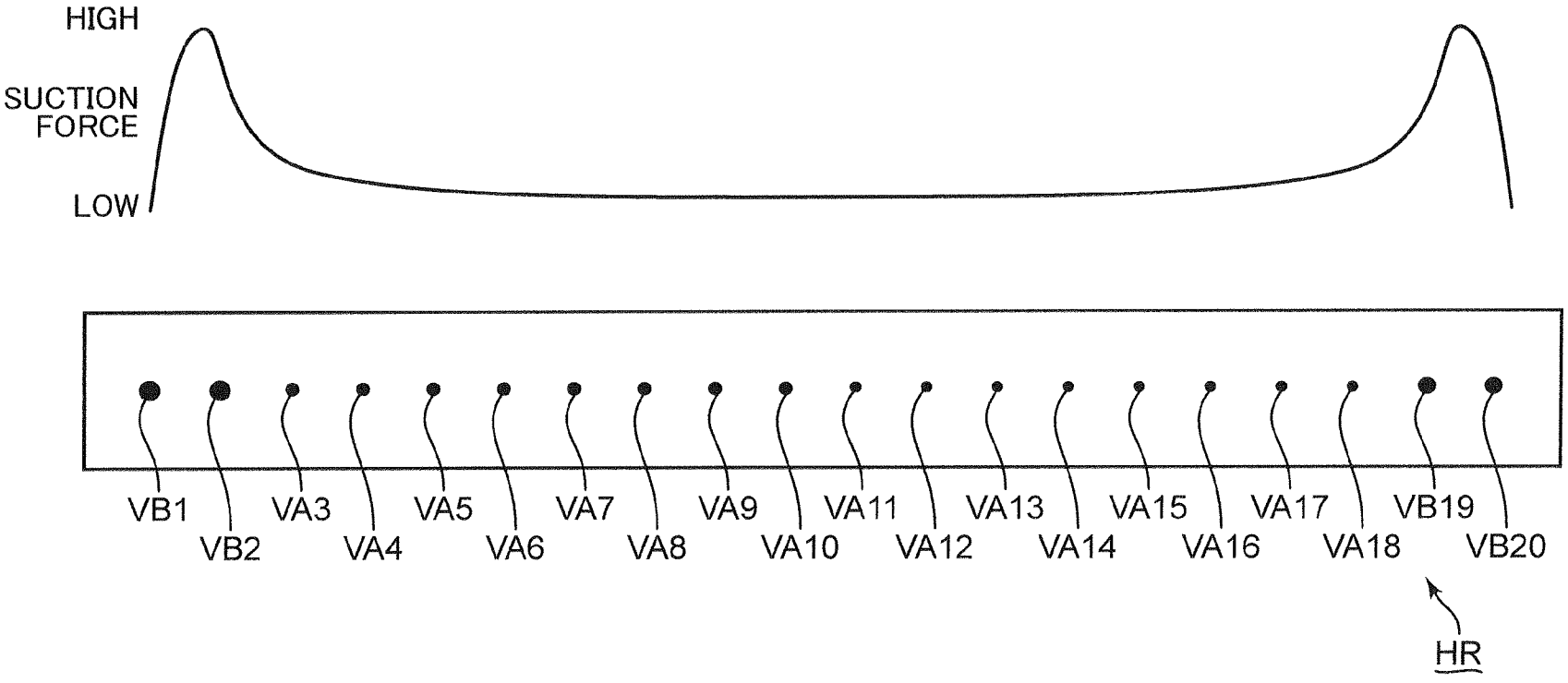
FIG. 12 is a schematic graph qualitatively showing a positional fluctuation of suction forces caused on the suction ports arranged according to the second arrangement pattern depicted in FIG. 9.

FIG. 12 is a schematic graph qualitatively showing a positional fluctuation of suction forces generated under the arrangement of the suction ports VB1, VB2, VA3 to VA18, VB19, VB20 according to the second arrangement pattern. The positional fluctuation of the suction force is described with reference to FIGS. 10 and 12.

As shown in FIG. 10, the region HR, in which the suction ports VB1, VB2, VA3 to VA18, VB19, VB20 are formed, is longer than the trunk 732. The suction ports VB1, VB2 formed in the terminal end region and the suction ports VB19, VB20 formed in the starting end region face the journals 733. As described above, the suction ports VB1, VB2, VB19, VB20 are wider than the other suction ports VA3 to VA18. Therefore, a large amount of toner is suctioned through the suction ports VB1, VB2, VB19, VB20. Since a suction force distribution is created to follow a distribution of the scattered toner amount, the scattered toner is suctioned efficiently.

(Third Arrangement Pattern)

Figure 13:
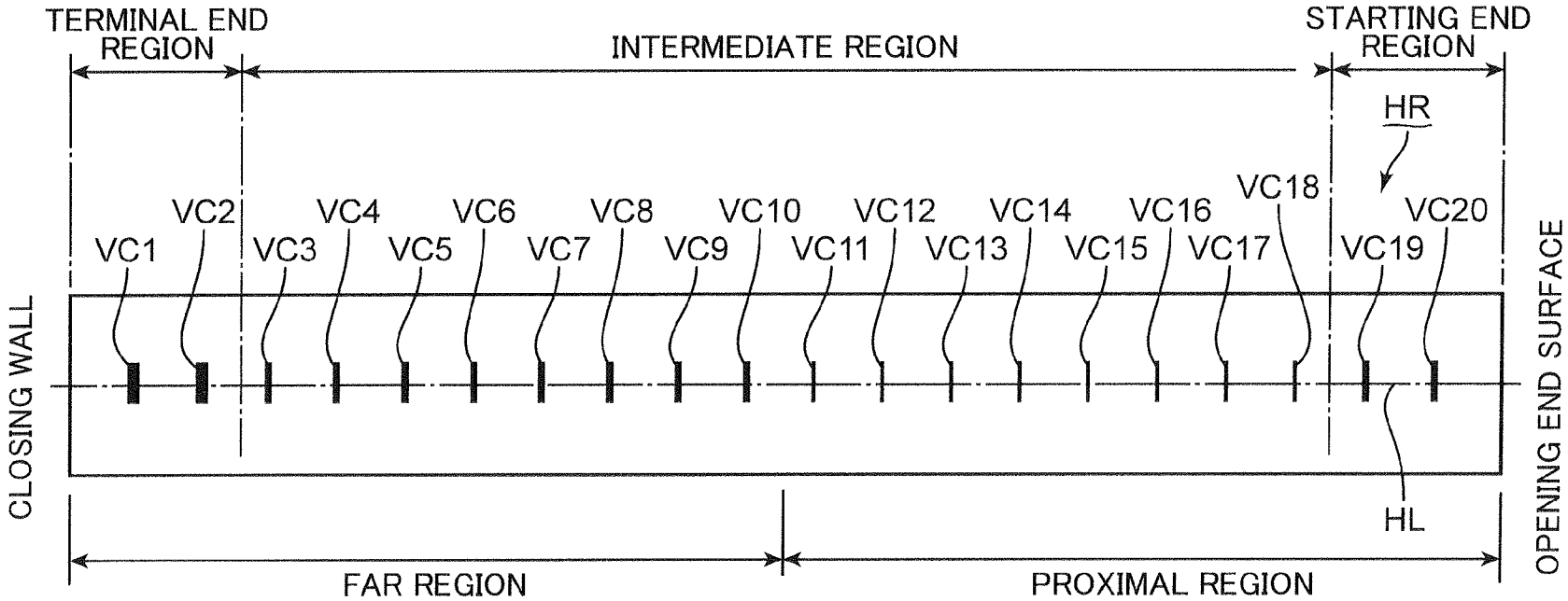
FIG. 13 schematically shows a third arrangement pattern of the suction ports formed in the developing device depicted in FIG. 6.

FIG. 13 schematically shows a third arrangement pattern of the suction ports formed in the region HR. The third arrangement pattern of the suction ports is described with reference to FIGS. 3, 9 and 13. It should be noted that the same features of the third arrangement pattern as the first and second arrangement patterns are not described hereinafter.

Substantially rectangular suction ports VC1, VC2 are formed in the terminal end region instead of the substantially circular suction ports VB1, VB2 described with reference to FIG. 9. Ventilation areas of the suction ports VC1, VC2 are equal to each other.

Substantially rectangular suction ports VC3 to VC10 are formed in the far region excluding the terminal end region instead of the substantially circular suction ports VA3 to VA10 described with reference to FIG. 9. Ventilation areas of the suction ports VC3 to VC10 are equal to one another.

Substantially rectangular suction ports VC19, VC20 are formed in the starting end region instead of the substantially circular suction ports VB19, VB20 described with reference to FIG. 9. Ventilation areas of the suction ports VC19, VC20 are equal to each other.

Substantially rectangular suction ports VC11 to VC18 are formed in the proximal region excluding the starting end region instead of the substantially circular suction ports VC11 to VC18 described with reference to FIG. 9. Ventilation areas of the suction ports VC11 to VC18 are equal to one another.

A magnitude relationship of the average ventilation area between the far and proximal regions is the same as that of the first arrangement pattern (and the second arrangement pattern). A magnitude relationship of the average ventilation area among the terminal end region, the intermediate region and the starting end region is the same as that of the second arrangement pattern.

As shown in FIG. 3, the cavity 755 of the guide tube 750 extends below the horizontal plane HP. Therefore, the suctioned toner may be deposited in the cavity 755. In the present embodiment, the cavity 755 is exemplified as the inner cavity.

Each of the suction ports VC1 to VC20 has a constant vertical dimension as shown in FIG. 13. However, the horizontal dimensions of the suction ports VC1 to VC20 vary among the terminal end region, the intermediate region, the starting end region, the far region and the proximal region.

The horizontal dimensions of the suction ports VC1, VC2 formed in the terminal end region are greater than those of the other suction ports VC3 to VC20. The horizontal dimensions of the suction ports VC19, VC20 formed in the starting end region are large next to those of the suction ports VC1, VC2. The horizontal dimensions of the suction ports VC3 to VC10 formed in the far region excluding the terminal end region are greater than those of the suction ports VC11 to VC18 formed in the proximal region excluding the starting end region. Therefore, in a region above the horizontal line HL across the suction ports VC1 to VC20, the average ventilation area in the proximal region is smaller than the average ventilation area in the far region. Consequently, a positional fluctuation of the suction forces remains low even when the suction ports VC1 to VC20 are partially closed by suctioned toner.

The principle of the aforementioned embodiment may enable recovery of toner by means of suction forces with a small positional fluctuation.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus for forming an image by means of toner, comprising:

an image carrier including an image carrying surface to form an electrostatic latent image;

a developing device which supplies the toner to the image carrying surface to form a toner image; and a suction device configured to create airflow for suctioning the toner scattered from the developing device, wherein the developing device includes a duct configured to guide the airflow to the suction device, the duct includes a connection port, to which the suction device is connected, and a suction surface provided with suction ports into which the toner flows, and the suction ports that are farther away from the connection port have a different opening size than the suction ports that are nearer to the connection port, the duct includes a closing surface opposite to the connection port, the suction surface extending between the connection port and the closing surface includes a starting end region closer to the connection port than the closing surface, a terminal end region closer to the closing surface than the connection port, and an intermediate region between the starting and terminal end regions, the suction ports include a starting end suction port group formed of suction ports formed in the starting end region, a terminal end suction port group formed of suction ports formed in the terminal end region, and an intermediate suction port group formed of suction ports formed in the intermediate region, and an average ventilation area in the intermediate suction port group is smaller than an average ventilation area in the starting end suction port group and an average ventilation area in the terminal end suction port group.

2. The image forming apparatus according to claim 1, wherein the suction ports have a total ventilation area, which is no more than an average internal cross-sectional area of the duct.

3. The image forming apparatus according to claim 2, wherein the suction surface includes a first region and a second region which is more distant from the connection port than the first region is, the suction ports include a first suction port group formed of suction ports formed in the first region and a second suction port group formed of suction ports formed in the second region, and an average ventilation area in the first suction port group is smaller than an average ventilation area in the second suction port group.

4. The image forming apparatus according to claim 3, wherein the suction ports are aligned along a horizontal line, an inner cavity of the duct includes a region extending below the horizontal line, and the average ventilation area in the first suction port group is smaller than the average ventilation area in the second suction port group above the horizontal line.

5. The image forming apparatus according to claim 3, wherein the first and second regions divide the suction surface into two sections.

6. The image forming apparatus according to claim 4, wherein the developing device includes a developing roller which rotates to supply the toner to the image carrying surface, and the horizontal line is situated blow a rotational axis of the developing roller.

7. The image forming apparatus according to claim 4, wherein a horizontal dimension of the suction ports formed in the first region is smaller than a horizontal dimension of the suction ports formed in the second region.

8. The image forming apparatus according to claim 1, wherein the developing device includes a developing roller which rotates to supply the toner to the image carrying surface, the developing roller includes a cylindrical trunk, which has a circumferential surface to supply the toner to the image carrying surface, and a journal extending from the trunk along a rotational axis of the developing roller, the journal is thinner than the trunk, and the suction surface is longer than the trunk.

9. The image forming apparatus according to claim 8, wherein at least one of the suction ports formed in the starting end region faces the journal.

10. The image forming apparatus according to claim 8, wherein at least one of the suction ports formed in the terminal end region faces the journal.

* * * * *